US009949885B2

(12) United States Patent
Keiser

(10) Patent No.: US 9,949,885 B2
(45) Date of Patent: Apr. 24, 2018

(54) SYSTEM AND METHOD FOR KNEE REHABILITATION

(76) Inventor: Darren Keiser, Omaha, NE (US)

( * ) Notice: Subject to any disclaimer, the term of this patent is extended or adjusted under 35 U.S.C. 154(b) by 819 days.

(21) Appl. No.: 13/606,334

(22) Filed: Sep. 7, 2012

(65) Prior Publication Data

US 2014/0073998 A1 Mar. 13, 2014

(51) Int. Cl.

| | |
|---|---|
| ***A61H 1/02*** | (2006.01) |
| ***A61H 11/00*** | (2006.01) |
| ***A63B 21/00*** | (2006.01) |
| ***A63B 23/035*** | (2006.01) |
| ***A63B 23/04*** | (2006.01) |
| *A63B 22/00* | (2006.01) |

(52) U.S. Cl.

CPC ..... *A61H 1/024* (2013.01); *A61H 11/00* (2013.01); *A63B 21/00178* (2013.01); *A63B 21/00185* (2013.01); *A63B 23/03508* (2013.01); *A63B 23/0494* (2013.01); *A61H 2001/0207* (2013.01); *A61H 2201/0157* (2013.01); *A61H 2201/0161* (2013.01); *A61H 2201/0192* (2013.01); *A61H 2201/1269* (2013.01); *A61H 2201/164* (2013.01); *A61H 2203/0431* (2013.01); *A63B 2022/0094* (2013.01); *A63B 2208/0233* (2013.01)

(58) Field of Classification Search

CPC A61H 1/024; A61H 1/0237; A63B 21/00185; A63B 21/00178; A63B 23/0494; A63B 23/04; A63B 23/03508; A63B 23/0405

See application file for complete search history.

(56) References Cited

U.S. PATENT DOCUMENTS

| | | | | | |
|---|---|---|---|---|---|
| 4,304,401 | A * | 12/1981 | Goodman | 482/123 | |
| 4,784,121 | A * | 11/1988 | Brooks | A61H 1/0237 | 482/131 |
| 5,074,549 | A | 12/1991 | Harvey | | |
| 5,290,209 | A * | 3/1994 | Wilkinson | 482/38 | |
| 5,538,487 | A * | 7/1996 | Fulmer | A63B 21/0023 | 482/41 |
| 5,656,002 | A * | 8/1997 | Dittmeier | A63B 21/151 | 482/114 |
| 5,720,699 | A * | 2/1998 | Musachio | A63B 21/05 | 482/121 |
| 5,772,563 | A * | 6/1998 | Lin | 482/140 | |
| 6,165,112 | A * | 12/2000 | Morris | 482/142 | |
| 8,870,715 | B2 * | 10/2014 | Stiles | A61H 1/024 | 482/49 |
| 2006/0258516 | A1 * | 11/2006 | Nolte | A63B 23/0494 | 482/92 |
| 2011/0046525 | A1 | 2/2011 | Stiles | | |

(Continued)

*Primary Examiner* — Justine Yu
*Assistant Examiner* — Kathrynn Lyddane
(74) *Attorney, Agent, or Firm* — Suiter Swantz pc llo

(57) ABSTRACT

The invention may be embodied in a physical therapy or health maintenance stretching system including a frame configured for engaging a treated leg of a user at or near the popliteal space of the treated leg to allow a knee of the treated leg to bend inwards in response to gravitational force affecting a lower portion of the treated leg. The frame may be further configured to allow a knee of the treated leg to bend inwards in response to a user force directly or indirectly applied to the lower portion of the treated leg.

19 Claims, 10 Drawing Sheets

(56) References Cited

U.S. PATENT DOCUMENTS

| | | | | |
|---|---|---|---|---|
| 2013/0110013 | A1* | 5/2013 | Carlson | A61H 1/024<br>601/5 |
| 2013/0225378 | A1* | 8/2013 | Burek | A63B 26/00<br>482/142 |

* cited by examiner

SYSTEM AND METHOD FOR KNEE REHABILITATION

TECHNICAL FIELD

The present disclosure generally relates to the field of joint therapy and more particularly to a system and method for improving knee mobility.

BACKGROUND

The progress of medical science has led to a variety of medical treatments for injuries and/or diseases affecting human joints. In particular, surgical procedures, such as anterior cruciate ligament (ACL) reconstruction, posterior cruciate ligament (PCL) reconstruction, total knee replacement, and the like, are often performed to treat joint and ligament injuries or diseases affecting knee mobility. A pre-surgery injury or disease as well as the surgery itself often causes the natural motion of the knee to be impaired as a result of muscular swelling, scar tissue, and any other muscular, nervous, or tissue ailment resulting from pre-surgical or surgical trauma.

Physical therapy is commonly provided for a patient having undergone a surgical procedure or other medical treatment affecting knee mobility to restore at least a portion of the natural motion of the patient's knee. If the physical therapy is unsuccessful at rehabilitating the knee, the patient may indefinitely suffer from a limited range of motion and/or a stiff leg caused by improper healing. It is, therefore, desirable to provide physical therapy to improve knee mobility for patients in a comfortable and easily accessible setting.

SUMMARY

The present disclosure is directed to a system and method for improving knee mobility of a user having undergone medical treatment for injury or disease affecting at least one of the user's knees.

In one aspect, the present disclosure is directed to a system for improving knee mobility after medical treatment for injury or disease, including: a support mechanism disposed proximate to a surface of a floor, the support mechanism configured for receiving a user having undergone medical treatment affecting knee mobility; and a substantially rectangular frame, said frame having a predetermined width corresponding to a waist size of the user, said frame including a top member having a padded portion, the padded portion of the top member configured for engaging a treated leg of the user at or near the popliteal space of the treated leg to support a thigh of the treated leg, allowing an extension of the thigh of the treated leg and the floor intersect at an angle in the range of 20 to 90 degrees, said frame further including two side members disposed substantially perpendicular to the thigh of the treated leg, said frame configured for inducing a knee of the treated leg of the user to bend inwards in response to gravitational force affecting a lower portion of the treated leg.

In another aspect, the present disclosure is directed to a system for improving knee mobility after medical treatment for injury or disease, including: a support mechanism disposed at an elevation in the approximate range of 15 to 40 inches from a surface of a floor, the support mechanism configured for receiving a user having undergone medical treatment affecting knee mobility; and a frame, said frame including a top member configured for engaging a treated leg of the user at or near the popliteal space of the treated leg to support a thigh of the treated leg, allowing an extension of the thigh of the treated leg and the floor intersect at an angle in the range of 20 to 90 degrees, said frame further including two side members, substantially parallel to one another, intersecting the floor at an angle in range of 40 to 80 degrees, said frame configured for inducing a knee of the treated leg of the user to bend inwards in response to gravitational force affecting a lower portion of the treated leg.

In another aspect, the present disclosure is directed to a method of improving knee mobility of a user having undergone medical treatment, including the steps of: providing a substantially rectangular frame, said frame having a predetermined width corresponding to a waist size of a user, said frame including a top member having a padded portion, the padded portion of the top member configured for engaging a treated leg of the user at or near the popliteal space of the treated leg to support a thigh of the treated leg, allowing an extension of the thigh of the treated leg and the floor intersect at an angle in the range of 20 to 90 degrees, said frame further including two side members disposed substantially perpendicular to the thigh of the treated leg; engaging the popliteal space of the treated leg of the user with a portion of the padded portion of the top member of the rectangular frame; and facilitating utilization of gravitational force to actuate a lower portion of the treated leg of the user to bend a knee of the treated leg inwards.

It is to be understood that both the foregoing general description and the following detailed description are exemplary and explanatory only and are not necessarily restrictive of the present disclosure. The accompanying drawings, which are incorporated in and constitute a part of the specification, illustrate subject matter of the disclosure. Together, the descriptions and the drawings serve to explain the principles of the disclosure.

BRIEF DESCRIPTION OF THE DRAWINGS

The numerous advantages of the disclosure may be better understood by those skilled in the art by reference to the accompanying figures in which.

DETAILED DESCRIPTION

Reference will now be made in detail to the subject matter disclosed, which is illustrated in the accompanying drawings.

FIGS. 1 through 9 generally illustrate a system and method for improving knee mobility, such as flexion, extension, rotation, range of motion, ease of motion, and the like. A patient having an injury or disease affecting knee mobility may undergo a medical treatment, such as ligament reconstruction, total knee replacement, fracture repair, or any other surgical or therapeutic treatment to alleviate the injury or disease. However, the medical treatment and/or the corresponding injury or disease may impair the patient's ability to move his or her knee. Accordingly, a system and method are provided to restore at least a portion of the knee mobility of the patient that existed before the patient was affected by the injury, disease, or medical treatment.

It is further contemplated that the system and method provided herein may be utilized to improve knee mobility for any individual regardless of whether or not the individual has impaired knee mobility. For example, the system and method provided herein may be utilized for athletic training. Alternatively, the system and method may be utilized to maintain existing knee mobility. The foregoing examples are merely included for illustrative purposes to demonstrate that the present disclosure may be extended to uses beyond providing physical therapy after medical treatment for injury or disease affecting knee mobility.

Figure 1:
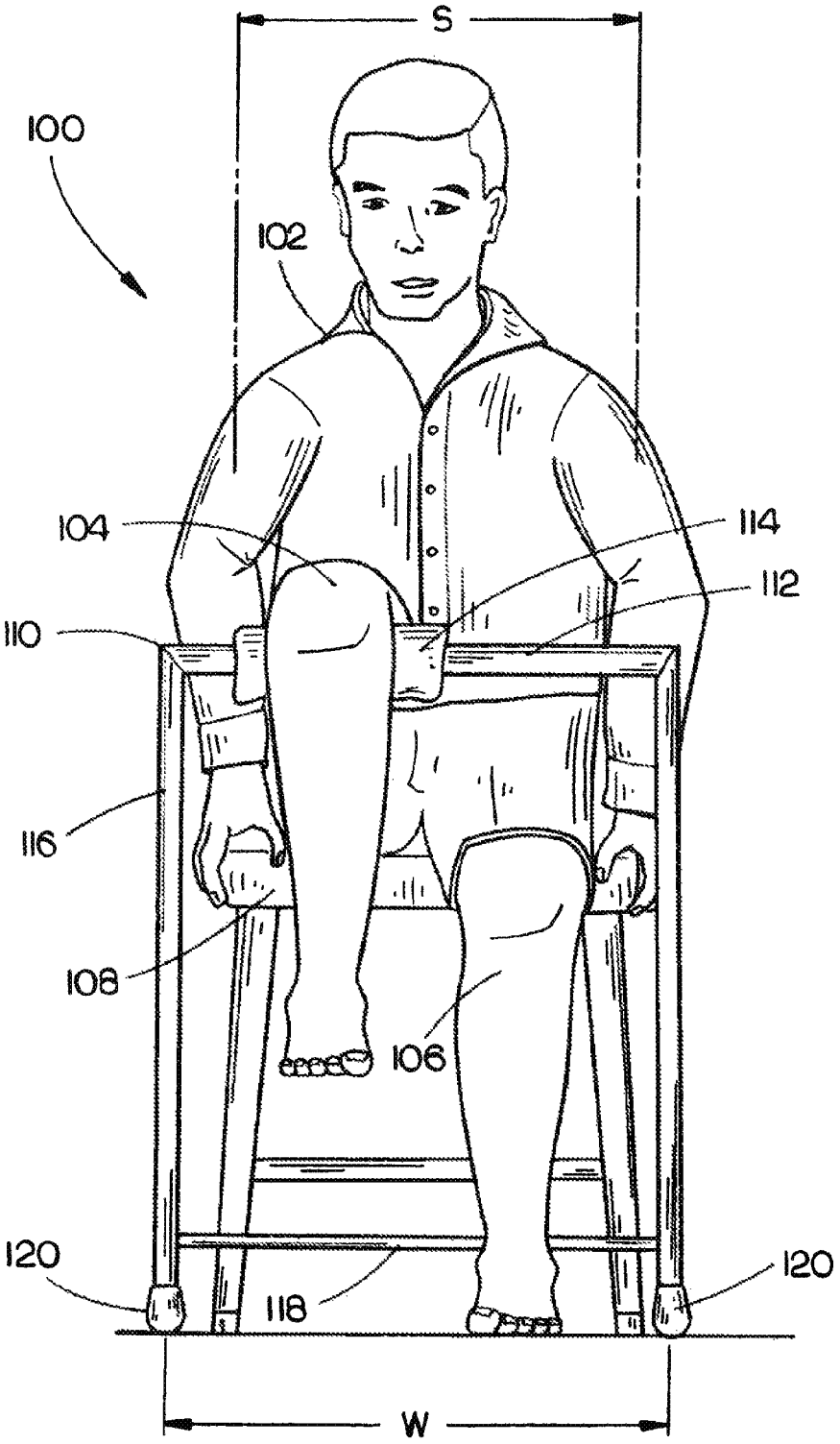
FIG. 1 is a front view illustrating a system for improving knee mobility after medical treatment for injury or disease.
Figure 2:
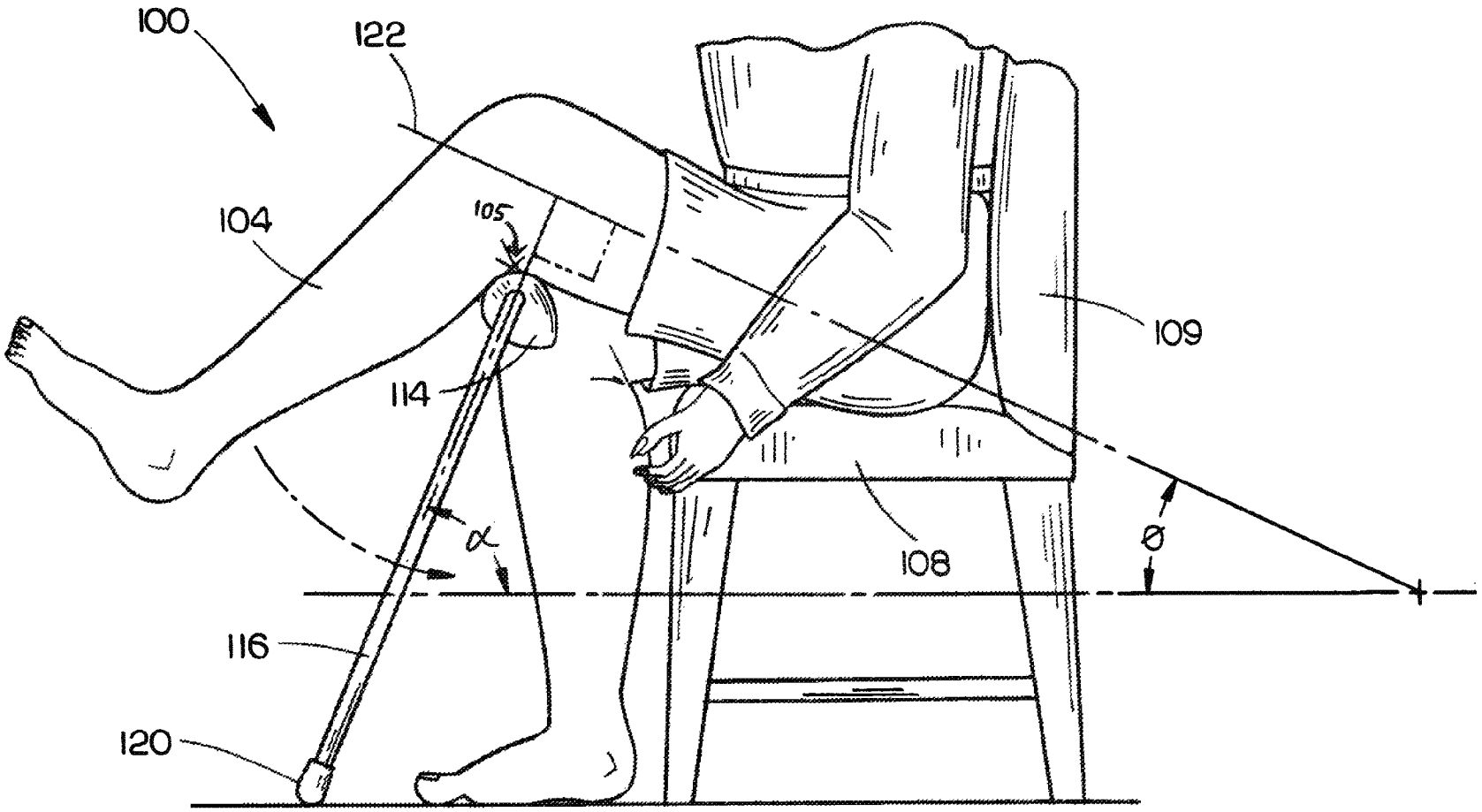
FIG. 2 is a partial side view of the system illustrated in FIG. 1.

FIGS. 1 and 2 illustrate a system 100 for improving knee mobility of a user 102 having undergone medical treatment for injury or disease affecting knee mobility in at least one treated leg 104 of the user 102. The system 100 may be utilized by the user 102 to engage in physical therapy to regain or improve knee mobility in the treated leg 104. It is contemplated that the system 100 may allow the user 102 to perform physical therapy in a variety of settings, such as a hospital, physical therapy center, home, and the like. Although the following discussion pertains to treating one leg of the user 104 while maintaining a resting (untreated) leg 106 disposed in a comfortable position, it is further contemplated that the system 100 could be extended to treating both legs 104 and 106 of the user 102, as would be recognized by all those skilled in the art.

The system 100 may include a support mechanism 108 configured for receiving the user 102 having undergone medical treatment affecting knee mobility. The support mechanism 108 may include a platform configured to support the user 102 in multiple locations, such as on a mat, padded or cushioned surface, bed, chair, or any other support structure. The support mechanism 108 may be disposed proximate to a surface of a floor, either in direct contact with the floor or at an elevation from the floor. For example, the support mechanism 108 may include a chair having an elevation in the range of approximately 15 to 40 inches from the surface of the floor.

The support mechanism 108 may optionally include a rear support member 109 configured for supporting the user's back to alleviate pressure on the user's spine. The rear support member 109 may be positioned at a substantially 90 degree angle from the floor to support the user 102 in a substantially upright position. Alternatively, the rear support member 109 may be positioned at an acute angle from the floor to support the user 102 in a reclined position. In some embodiments, the rear support member 109 may be further configured to adjust to a plurality of positions, allowing the user 102 or another person (e.g. doctor, nurse, physical therapist, medical aid, trainer, etc.) to position the rear support member 109 to a desired angle from the floor.

The system 100 may further include a frame 110 configured for engaging the treated leg 104 of the user 102 to allow flexion of the treated leg 104 in response to gravitational and/or user forces. The frame 110 may include a top member 112 configured for substantially engaging the treated leg 104 at or near the popliteal space 105 of the treated leg 104. For example, the top member 112 may be configured for engaging a region behind the knee or at the back part of the thigh of the treated leg 104. The frame 110 may further include two side members 116, each being coupled to an end of the top member at a substantially 90 degree angle. The two side members 116 may be configured to elevate the top member 112 to support the knee of the treated leg 104 at an elevation from the floor. The frame 110 may further include a bottom member 118 disposed parallel to the top member 112 in between the two side members 116. Each of the two side members 116 may be further coupled to an end of the bottom member 118 at a substantially 90 degree angle, such that the top member 112, the two side members 116, and the bottom member 118 form a substantially rectangular structure. The bottom member 118 may be configured to hold together the two side members 116 to provide structural support for the frame 110 as a whole.

In one embodiment, the frame 110 may be a substantially rectangular frame having a predetermined width W corresponding to a waist size S of the user 102. The width W may be defined as a distance in between the two side members 116 of the frame 110, a length of the top member 112 of the frame 110, or any dimension defining a portion of the frame 110 configured for engaging the treated leg 104 of the user 102. The waist size S of the user 102 may be defined as the width of the user's waist, a distance across the user's midriff substantially measured from the user's left hip to the user's right hip, a distance separating the user's hips, or any other body dimension associated with the perimeter, width, or depth of the user's waist.

In a further embodiment, the frame 110 may have a selected width W chosen from a plurality of standardized width dimensions. For example, the width W of the frame 110 may be selected from a plurality of standard sizes (e.g. Small, Medium, Large, Extra-large) associated with a plurality of width W dimensions. Accordingly, an appropriately sized frame 110 may be specified for the user 102 based upon the waist size S of the user 102.

As illustrated in FIG. 2, the two side members 116 of the frame 110 may be positioned at a substantially 90 degree angle relative to a thigh of the treated leg 104 of the user 102. Disposing the two side members 116 substantially perpendicular to the thigh of the treated leg 104 may enable the top member 112 to provide support for the thigh of the treated leg 104 while allowing a lower portion of the treated leg 104 below the knee to hang limply. Accordingly, the frame 110 may be configured for allowing the lower portion of the treated leg 104 to be actuated by gravitational force, causing flexion of the knee of the treated leg 104, whereby the knee bends inwards in a motion causing the angle between the thigh and the lower portion of the treated leg 104 to be reduced.

The frame 110 may be further configured to support the knee of the treated leg 104 at an elevation so that the thigh of the treated leg 104 is held at an angle θ from the floor. For example, a conceptual extension 122 of the thigh may intersect the floor at an angle θ in the range of approximately 20 to 90 degrees. The two side members 116 of the frame 110 may be further configured to intersect the floor at an angle α in order to maintain a perpendicular alignment between the two side members 116 of the frame 110 and the thigh of the treated leg 104 while allowing the thigh to be supported at an elevated angle θ. For example, the angle α between the two side members 116 and the floor may be in the range of approximately 40 to 80 degrees.

The frame 110 may be configured to maintain the substantially perpendicular alignment of the two side members 116 relative to the thigh of the treated leg 104 in addition to keeping the thigh at the elevated angle θ because doing so may allow gravitational force to actuate the lower portion of the treated leg 104. Increasing the angle θ of elevation of the thigh from the floor may facilitate improved actuation of the lower portion of the treated leg 104 utilizing gravitational force. In addition, the perpendicular alignment of the two side members 116 relative to the thigh of the treated leg 104 may provide improved support of the thigh of the treated leg 104, thereby reducing strain on muscles of the treated leg 104 and allowing the lower portion of the treated leg 104 to hang limply subject to actuation by gravitational force.

In one embodiment, frame 110 may be configured to engage the treated leg 104 of the user 102 to form a substantially right triangle having sides delineated by the conceptual extension 122 of the thigh, the two side members 116, and the floor. Accordingly, the angle θ between the floor and the conceptual extension of the thigh of the treated leg 104 and the angle a between the two side members 116 and the floor may have values necessary to form said substantially right triangle.

Figure 3:
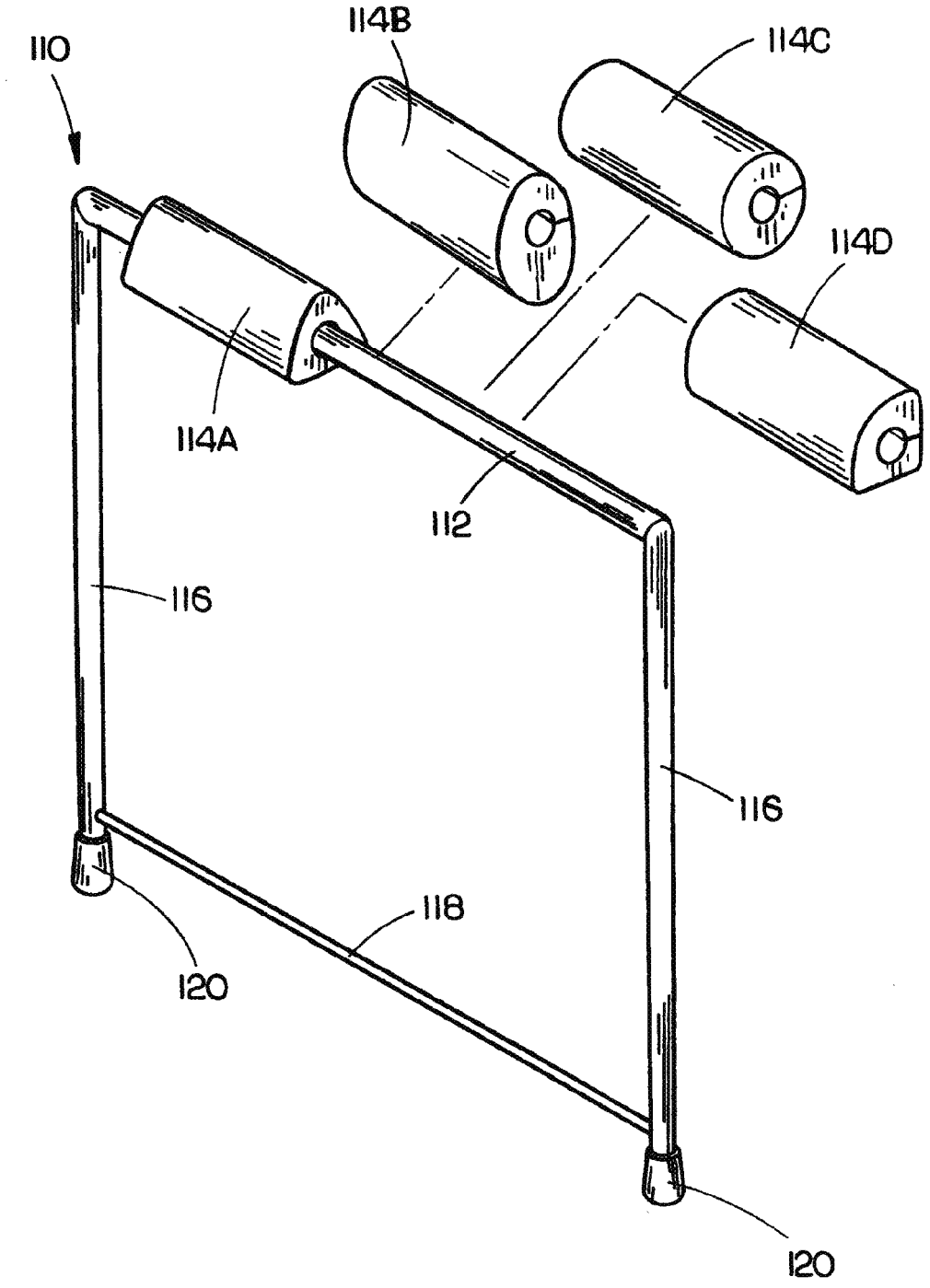
FIG. 3 is an isometric view of the frame of the system illustrated in FIG. 1.
Figure 4:
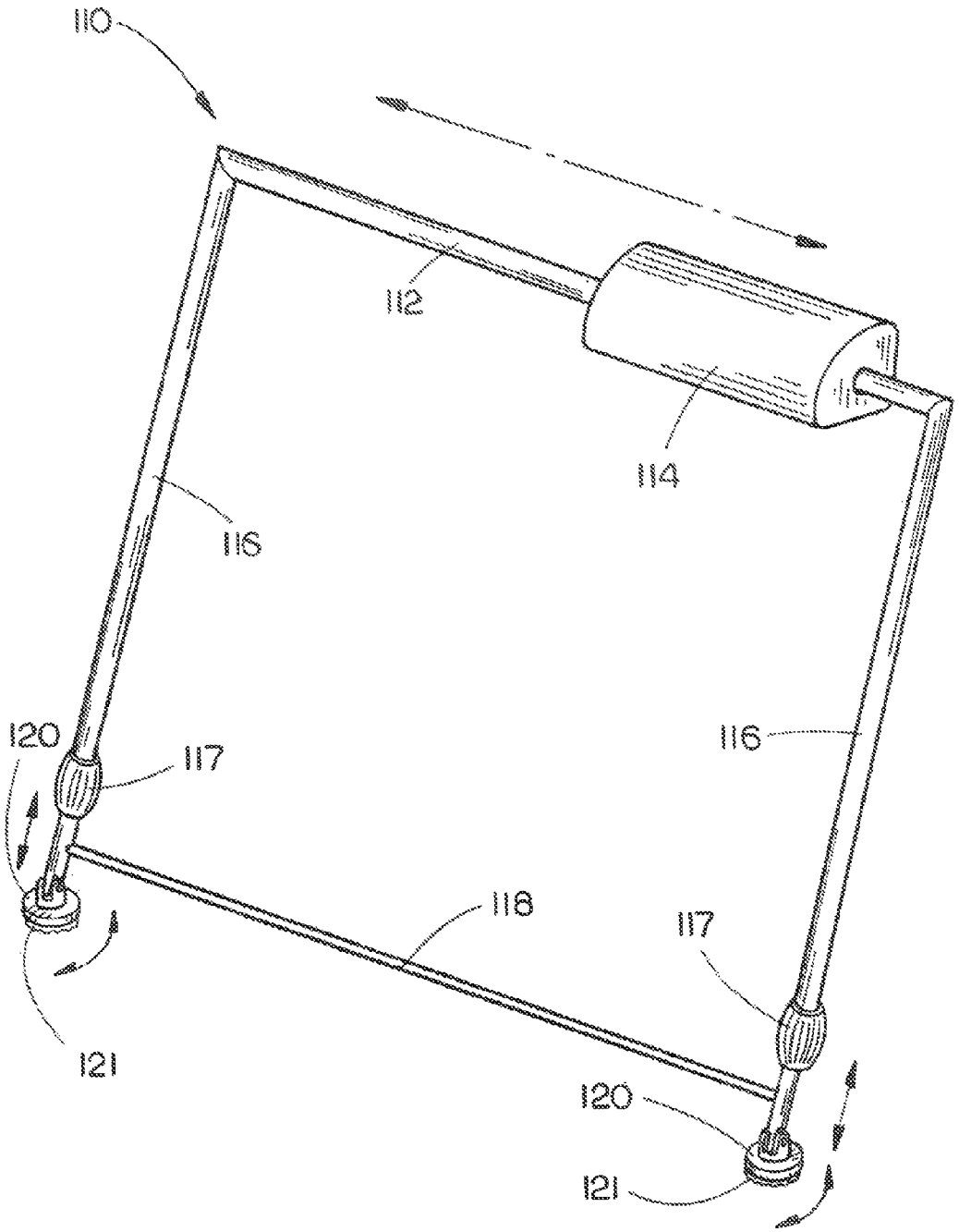
FIG. 4 is an isometric view of the frame of the system illustrated in FIG. 1.
Figure 5:
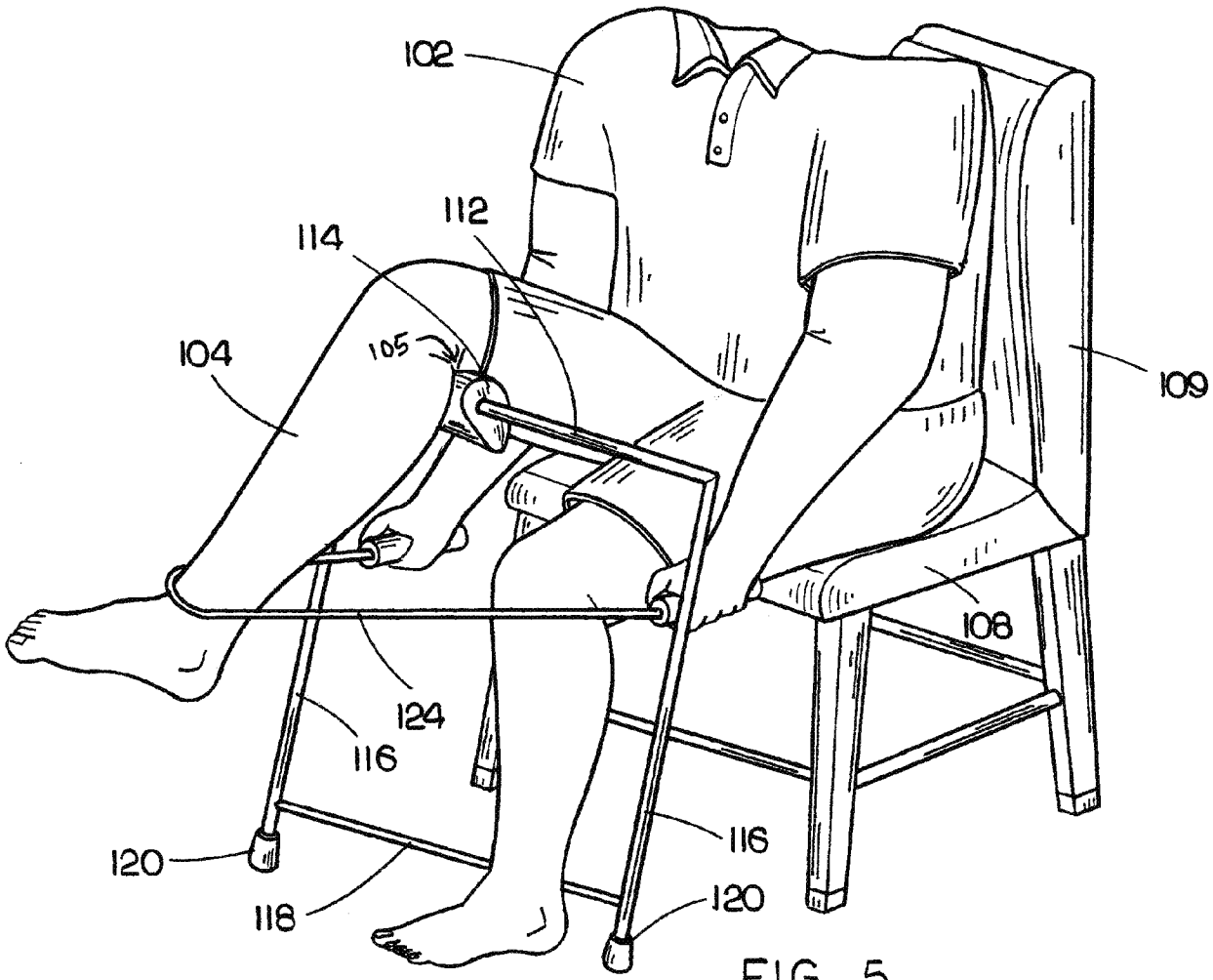
FIG. 5 is an isometric view of the system in FIG. 1, including a strap configured for engaging a lower portion of a treated leg of a user.
Figure 6:
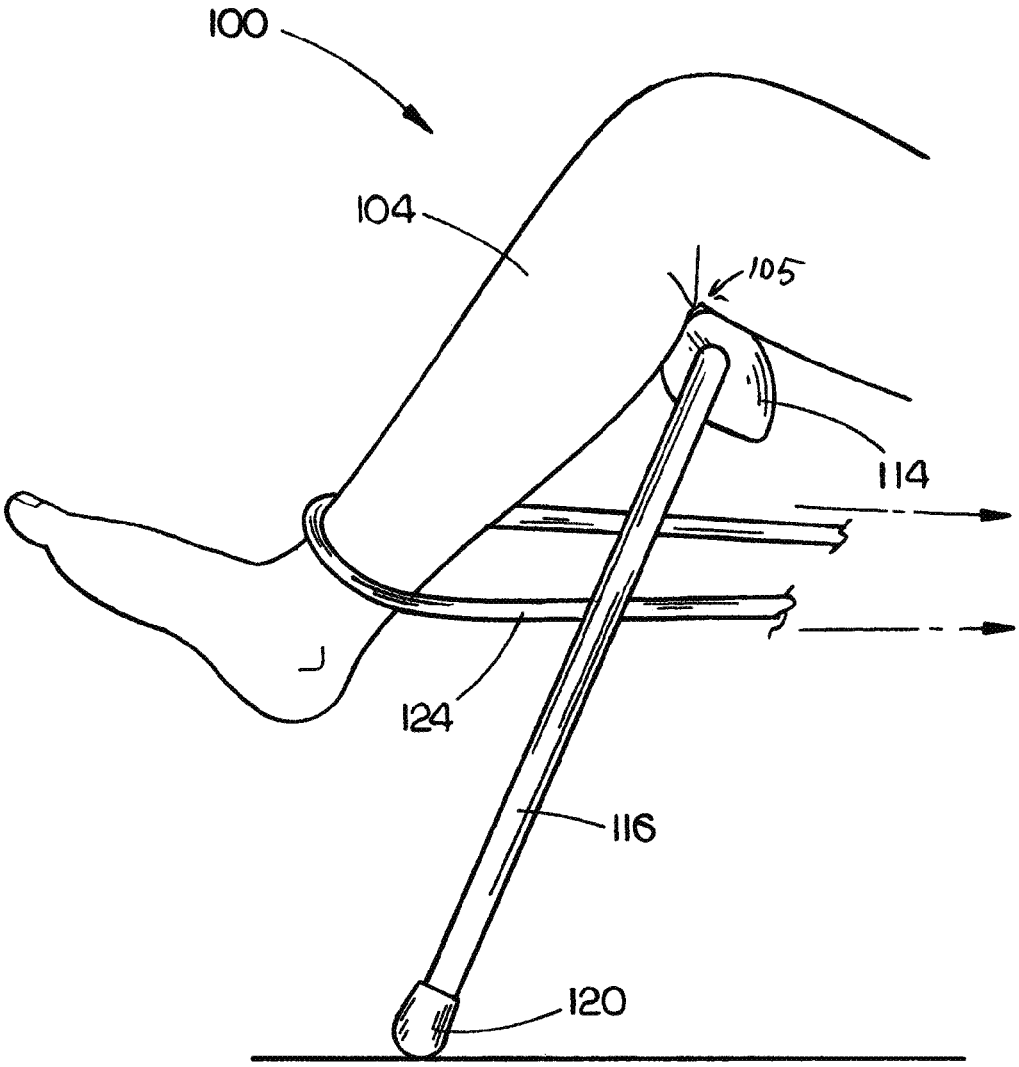
FIG. 6 is a partial side view of the system illustrated in FIG. 5.

FIGS. 3 and 4 are illustrative of some alternative embodiments of the frame 110. For example, in one embodiment the top member 112 of the frame 110 may include a padded portion 114 extending along at least a portion of the top member 112. The padded portion 114 may be a fabricated portion of the top member 112. Alternatively, the padded portion 114 may be permanently attached to the top member 112. Alternatively, the padded portion 114 may be removably attached to the top member 112. The padded portion 114 of the top member 112 may be configured to engage the treated leg 104 at or near the popliteal space 105 of the treated leg 104 of the user 102. The padded portion 114 of the top member 112 may provide improved comfort and/or traction for the user 102 utilizing the frame 110 for a physical therapy session.

In one embodiment, shown in FIG. 3, the padded portion 114 of the top member 112 may include a deformable or flexible material, such as rubber foam or a deformable container bearing a liquid or semisolid substance, such as a gel pack. Alternatively, the padded portion 114 of the top member 112 may include a rigid material, such as plastic or metal, ergonomically shaped to cradle the treated leg 104. For example, the padded portion 114 may include a C-shaped catch (cradle) coupled to the top member 112 with a hinge allowing the padded portion 114 to freely rotate around the top member 112 to accommodate user movement and/or multiple positions of the frame 110.

The padded portion 114 may be selected from a variety of shapes and/or sizes (e.g., as depicted in FIG. 3, elements 114A, 114B, 114C, and/or 114D). The padded portion 114 may be ergonomically shaped to provide comfort for specified user attributes and/or therapies. The padded portion 114 may be configured to fit snugly around a portion of the top member 112. For example, the padded portion 114 may include an opening configured to receive a portion of the top member 112 snugly. In addition, the padded portion 114 may include a slit along the length of the padded portion 114 configured for removably attaching the padded portion 114 to the top member 112. It is further contemplated that the padded portion 114 may be permanently or removably attached to the top member 112 via alternative fastening means such as an adhesive fastener, a button, a belt, a VELCRO fastener, and the like.

In one embodiment, shown in FIG. 4, the frame 110 may include adjustable features. For example, the frame 110 may be configured to have adjustable dimensions, such as height and width. It is contemplated that the frame 110 may have means for adjusting the height or width incorporated into the top member 112, the two side members 114, and/or the bottom member 118, respectively. For example, the frame 110 may include interlocking segments, telescopic segments 117, or any other adjustable means known to the art. In addition the padded portion 114 may be translatable to a plurality of positions along the top member 112. For example, the padded portion 114 may be translated from one side of the top member 112 to another side in order to accommodate treatment of the user's right or left leg. Alternatively, the padded portion 114 may be positioned at alternative positions along the top member 112 by attachment to a plurality of locations along the top member 112 configured to receive the padded portion 114.

In one embodiment, the frame 110 may further include end members 120 configured for engaging the floor to stabilize the frame 110. The end members 120 may include bases 121 and/or hinges configured to provide traction between the end members 120 and the floor. The end members 120 may be further configured to pivot to a plurality of angles from the floor. In one embodiment, the end members 120 may include bases 121 to provide traction and hinges configured to pivot to a plurality of angles, allowing the bases 121 to maintain a flat contact with the floor and simultaneously allowing the frame to be positioned at one or more angles from the floor.

In one embodiment, the frame 110 may be further configured to collapse into a portable form for convenient transportation. For example, the frame 110 may be configured to disassemble into multiple segments. Alternatively, the frame 110 may include hinges separating one or more segments of the frame 110 (e.g. between the top, side, and bottom members) allowing the frame 110 to be collapsed upon itself into a portable form. Alternatively, the frame 110 may include telescopically connected segments like those often utilized in handles of luggage bags, allowing the frame 110 to be collapsed into a portable form. It is further contemplated that other collapsible devices known to the art may be included to make the frame 110 portable without departing from the present disclosure.

It is further contemplated that the frame 110 may also be configured for engaging a portion of the treated leg 104 behind an ankle of the treated leg 104. The padded portion 114 of the top member 112 of the frame 110 may be configured for supporting the ankle of the treated leg 104 at an elevation so that the treated leg 104 is extended. Accordingly, the frame 110 may be configured for improving knee mobility of the treated leg 104 by allowing extension for a desired period of time. Thus, the frame 110 may be configured for enhancing both knee flexion and extension.

FIGS. 5 through 8 illustrate various means by which the user 102 may apply additional force to the lower portion of the treated leg 104. In one embodiment, shown in FIGS. 5 and 6, the system 100 may include a strap 124 configured for engaging the lower portion of the treated leg 104. For example, the strap 124 may engage the lower portion of the treated leg 104 near the ankle of the treated leg. The strap 124 may be further configured to actuate the treated leg 104 so that the knee is forced to bend inwards as a result of the user 102 applying a force, such as a pulling force, to the strap 124.

Figures 7A, 7B:
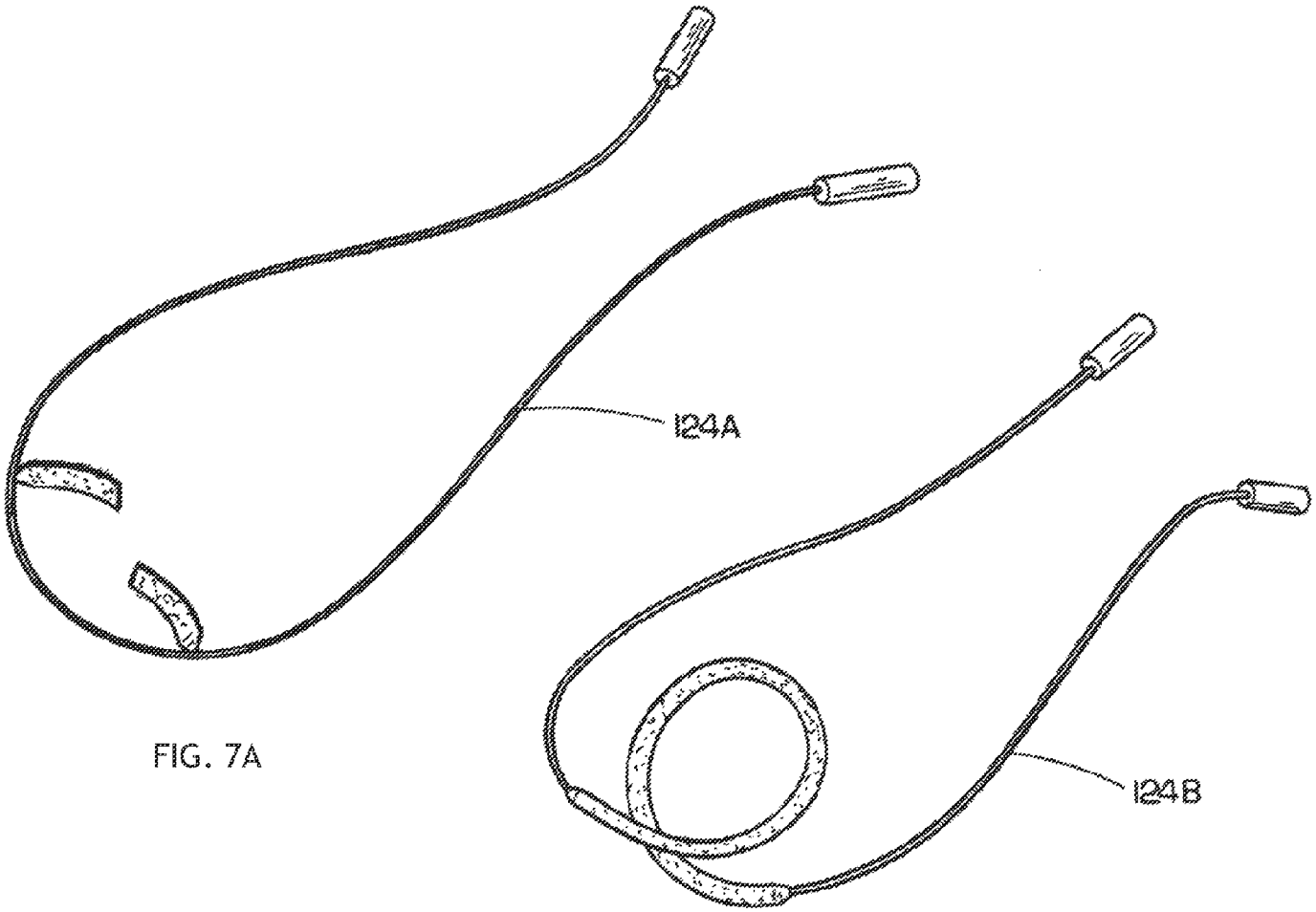
FIG. 7A is a top view illustrating an embodiment of the strap of the system illustrated in FIG. 5.
FIG. 7B is a top view illustrating another embodiment of the strap of the system illustrated in FIG. 5.

FIGS. 7A and 7B illustrate two exemplary embodiments of the strap 124 (labeled 124A and 124B for illustration purposes); however, it is contemplated that the strap 124 may be significantly altered from the embodiments described herein without departing from the present disclosure. In one embodiment, the strap 124A as shown in FIG. 7A may include a fastener configured to maintain snug contact between the strap 124A and the lower portion of the treated leg 104. Alternatively, the strap 124B as shown in FIG. 7B may be configured to completely encircle a portion of the lower portion of the treated leg 104 to maintain snug contact between the strap 124B and the lower portion of the treated leg 104. In a further embodiment, the strap 124 may have appropriate dimensions based on body dimensions of the user 102 to enable the user 102 to actuate the strap 124 while maintaining a substantially upright position.

Figure 8:
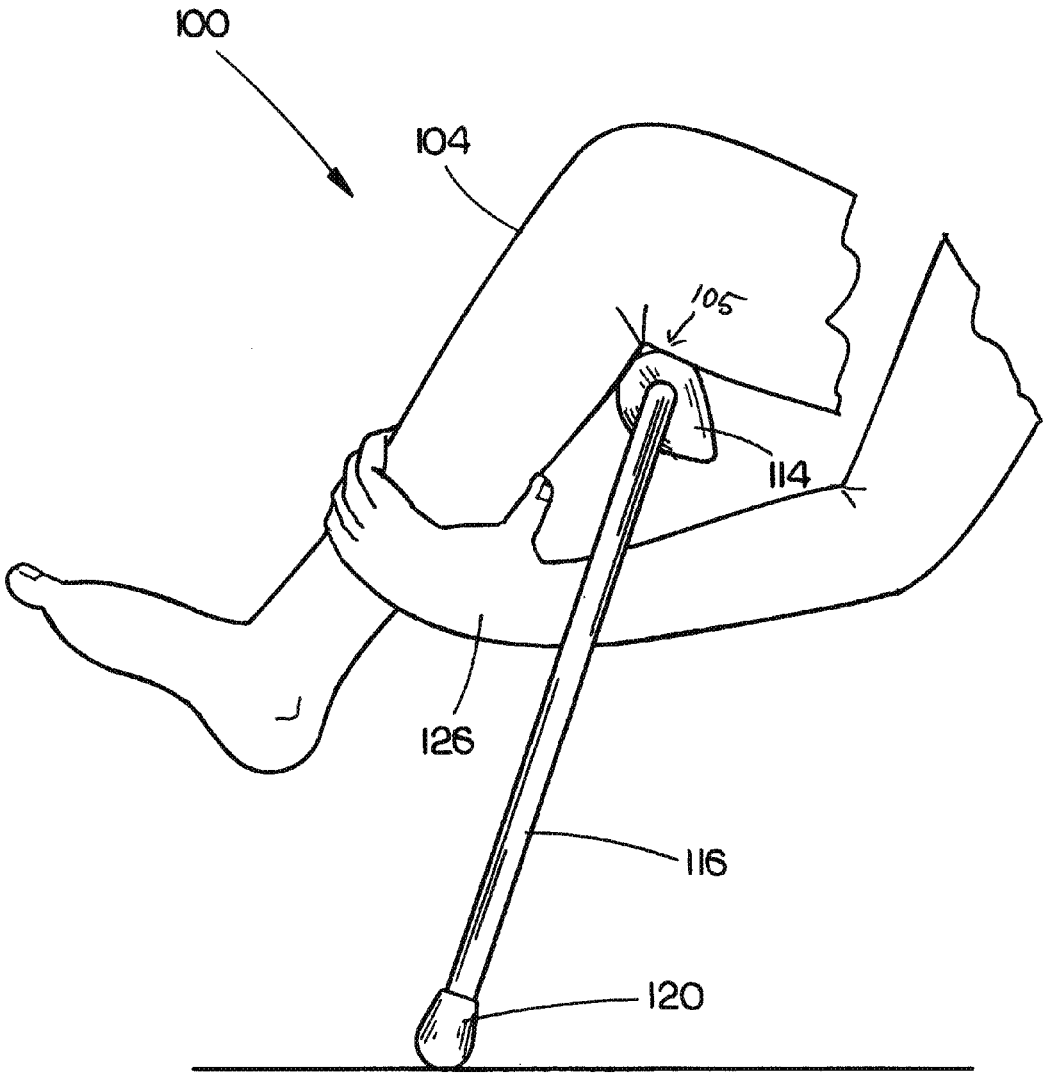
FIG. 8 is a partial side view illustrating a user directly engaging a lower portion of a treated leg of the user.

The strap 124 is included by way of example as a means of applying user force to the lower portion of the treated leg 104 to cause inward bending of the knee; however, several alternative means are known to the art. For example, the user 102 may apply force to actuate the lower portion of the treated leg 104 by engaging the lower portion of the treated leg 104 with one or both hands 126 of the user 102 and applying a force, such as a pulling force, to bend the knee of the treated leg 104 inwards, as shown in FIG. 8. Other means for engaging the lower portion of the treated leg 104 to bend the knee of the treated leg 104 inwards may include, but are not limited to, a rag or cloth, a rigid or elastic belt, a rope, a rigid structure configured to cradle the lower portion of the treated leg, or any other suitable means known to the art.

Figure 9:
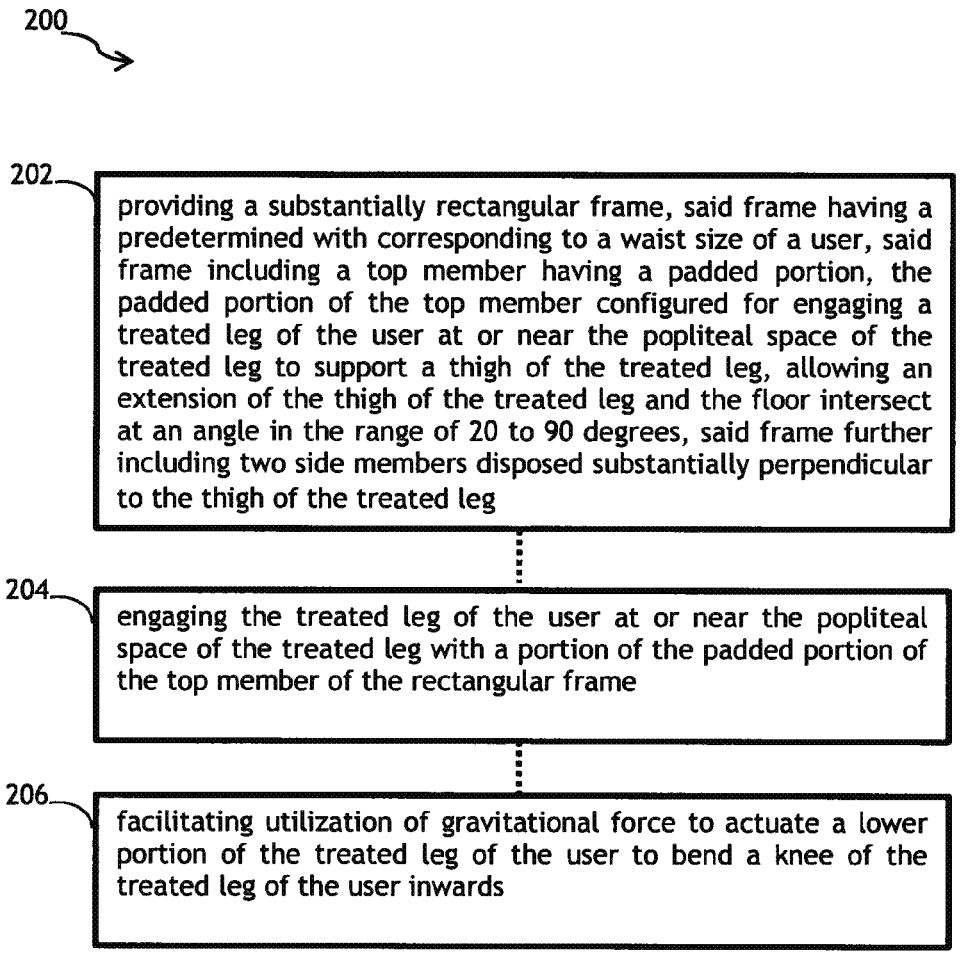
FIG. 9 is a flow diagram illustrating a method for improving knee mobility after medical treatment for injury or disease.
Figure 10:
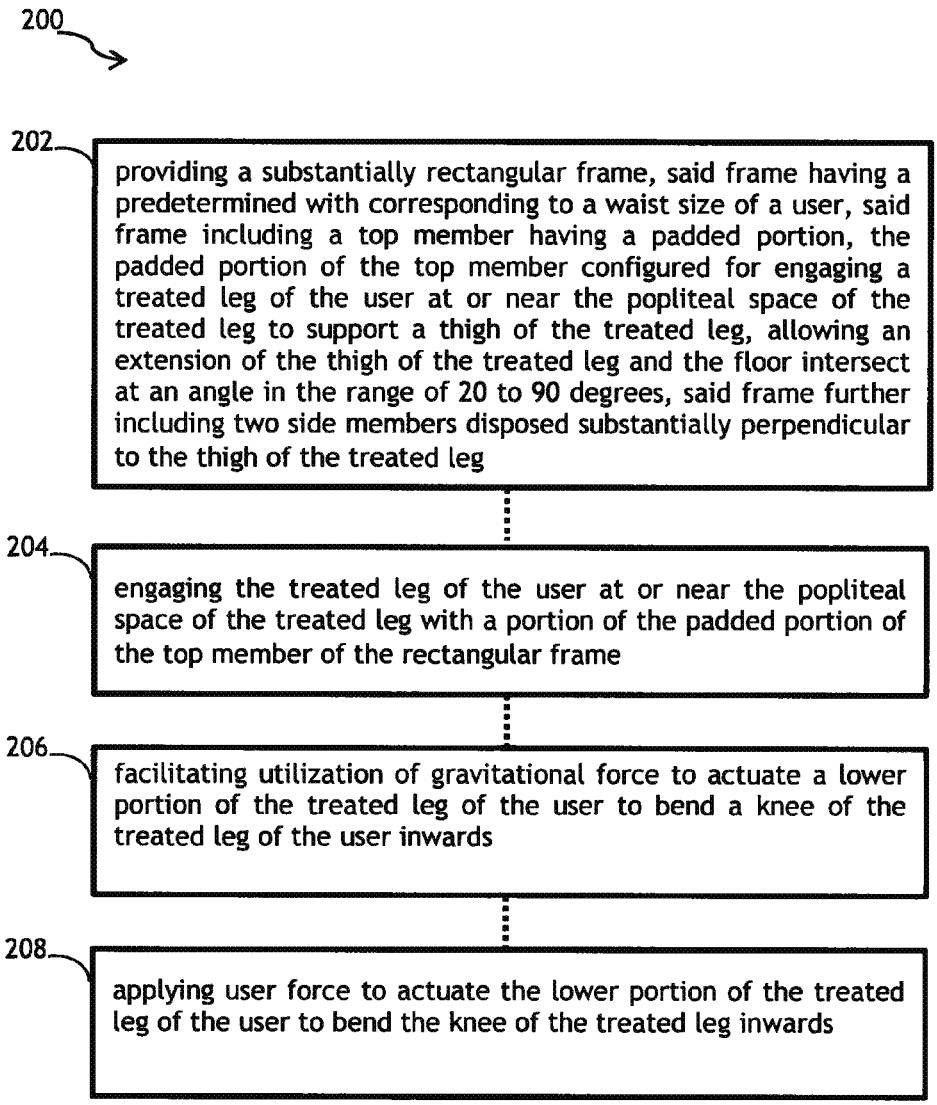
FIG. 10 is a flow diagram illustrating a method for improving knee mobility after medical treatment for injury or disease.

FIGS. 9 and 10 illustrate a method 200 of improving knee mobility of the treated leg 104 of the user 102 in accordance with system 100. It is noted herein that method 200 may be carried out to improve knee mobility of the treated leg 104 of the user 102 by the user 102 alone. Alternatively, another person may aid the user in carrying out one or more steps of method 200. It is further noted herein that one or more of the following steps may be excluded, additional steps may be included, and steps may be rearranged for method 200 without departing from the present disclosure.

Method 200 may include a step 202 of providing the frame 110 for the user 102 to engage in physical therapy exercises to improve knee mobility of the treated leg 102. It is further contemplated that step 202 of providing the frame 110 should not be limited to the field of physical therapy exercises and could alternatively be extended to fields of athletic training or health maintenance, wherein the frame 110 may be similarly utilized to simply stretch or to improve or maintain knee mobility of one or both of the user's legs.

Method 200 may further include a step 204 of engaging the treated leg 104 at or near the popliteal space 105 of the treated leg 104 of the user 102 with the top member 112 of the frame 110. In one embodiment, step 204 may further include engaging the treated leg 104 at or near the popliteal space 105 of the treated leg 104 with the padded portion 114 of the top member 112 for improved comfort and/or traction.

Method 200 may further include a step 206 of facilitating the use of gravitational force to actuate the lower portion of the treated leg 104 so that the knee of the treated leg 104 is caused to bend inwards. Step 206 may be implemented by engaging the treated leg 104 at or near the popliteal space 105 of the treated leg 104 with the frame 110 and aligning the frame 110 so that the lower portion of the treated leg 104 hangs limply extended beyond the frame 110. In addition, supporting the knee of the treated leg 104 at an elevation so that the thigh of the treated leg 104 is positioned at an angle from the floor may better facilitate utilization of gravitational force to actuate the lower portion of the treated leg 104 to bend the knee of the treated leg 104 inwards (i.e. enhance knee flexion).

In a further embodiment, shown in FIG. 10, method 200 may include a step 208 of applying user force to further actuate the lower portion of the treated leg 104 so that the knee may be bent inwards further. For example, the user force may be applied directly by the user 102 by engaging the lower portion of the treated leg 104 with one or both of the user's hands 126 and applying force to actuate the lower portion of the treated leg 104 so that the knee is bent inwards as a result. Alternatively, the user may utilize a strap 124 or another actuation means to engage the lower portion of the treated leg 104 and indirectly apply user force to actuate the lower portion of the treated leg 104 so that the knee is bent inwards as a result. It is further contemplated that another person (e.g. therapist, physician, trainer, friend, etc.) may assist by applying a user force and/or positioning a weight to apply additional force to the lower portion of the treated leg 104 so that the knee flexes or bends inwards as a result.

In a further embodiment, outwards bending or extension of the knee may be facilitated by resting the back of the ankle on the padded portion of the frame. Gravitational force on the extended leg 104 may actuate the knee to bend outwards further. In addition, a downwards force may be applied to the thigh to force the knee to bend outwards further. In one embodiment, a weighted assembly or user force may be applied to an upper portion of the thigh. For example, the weighted assembly may include a strap having at least one weighted end, a weighted sleeve, or any relatively heavy object, such as a phonebook, gel pack, sandbag, and the like.

In one embodiment, step 208 may be included at a specified stage in physical therapy following a medical treatment for injury or disease affecting knee mobility of the user 102. For example, in a first period of time following medical treatment the user 102 may have stiffness or swelling in the knee of the treated leg 104 making inwards bending of the knee difficult. Accordingly, the user 102 may only practice step 206 of allowing gravitational force to actuate the lower portion of the treated leg 104 for therapy sessions during the first period of time following medical treatment until the stiffness or swelling is reduced. Therapy sessions may include time intervals and/or repetitions prescribed by a professional, such as a doctor, therapist, trainer, and the like. For example, the therapy sessions may include time intervals in the range of 5 minutes to 3 hours or 50 to 500 repetitions three times daily. In one embodiment, the therapy sessions may include 10 minute exercises, 3 times per day. Alternatively, the user may select a desired time interval and/or number of repetitions for a therapy session.

Exercises to enhance knee extension may be similarly directed by a professional or completed by the user as desired. The user 102 may extend the treated leg 104 utilizing the frame for prescribed or desired time intervals. For example, the user 102 may hold the treated leg 104 in an extended position utilizing the frame for 20 seconds, 10 to 50 times per day. In addition, the user 102 may supply user force and/or utilize a weight to apply additional downwards force on the thigh of the treated leg 104 to promote outwards bending (i.e. extension) of the knee. It is further contemplated that another person (e.g. therapist, physician, trainer, friend, etc.) may assist by applying a user force and/or positioning a weight to apply additional downwards force on the thigh of the treated leg 104.

In a further embodiment, the user may begin to practice step 208 of applying user force to bend the knee of the treated leg 104 inwards further as the swelling of the knee following medical treatment is sufficiently reduced. However, the user 102 may still have relatively limited mobility making it difficult for the user 102 to reach the lower portion of the treated leg 104 without the aid of a strap 124 or another means of actuating the lower portion of the treated leg 104 with an indirectly applied user force. Accordingly, the user 102 may apply an indirect user force utilizing the strap 124 or another actuation means for therapy sessions during a second period of time (e.g. 2 days to 8 weeks) until the user 102 is capable of reaching the lower portion of the treated leg 104 without having to put undue strain upon the user's back. For example, the user 102 may eventually be able to reach the lower portion of the treated leg 104 without bending the user's back significantly from a substantially upright position.

Thereafter, the user 102 may begin applying direct user force using one or both hands to actuate the lower portion of the treated leg 104 for therapy sessions. The user may continue to apply direct user force to actuate the lower portion of the treated leg 104 for therapy sessions for a remainder of the total physical therapy. For example, the user may apply direct user force to actuate the lower portion of the treated leg for a specified third period of time (e.g. 2 to 12 weeks) or as long as the user 102 or the prescribing professional desires.

It is noted herein that the foregoing examples relating to time periods and or other numerical boundaries are included for illustrative purposes only and should not be construed to limit the present disclosure in any way. It is contemplated that users having different ailments or goals may utilize the system 100 in a manner and time period suitable for the results they desire. Accordingly, the illustrative examples and embodiments disclosed herein should be understood to extend to treatments or therapies that may be unique to the user 102.

In the present disclosure, it should be understood that the specific order or hierarchy of steps in the methods disclosed are examples of exemplary approaches. Based upon design preferences, it is understood that the specific order or hierarchy of steps in the method can be rearranged while remaining within the disclosed subject matter. The accompanying method claims present elements of the various steps in a sample order, and are not necessarily meant to be limited to the specific order or hierarchy presented.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes.

What is claimed is:

1. A system for improving knee mobility after medical treatment for injury or disease, comprising:

a support mechanism disposed proximate to a surface of a floor, the support mechanism configured for receiving a user having undergone medical treatment affecting knee mobility; and a rigid and substantially rectangular frame, said frame consisting of a top member, two side members and a bottom member arranged in a same plane to form the substantially rectangular frame, said frame having a predetermined width adapted to correspond to a waist size of the user, said top member having a padded portion, the padded portion of the top member configured for engaging a treated leg of the user at or near the popliteal space of the treated leg to support the popliteal space of the treated leg at a raised position, and said two side members terminating in bases immediately adjacent to the bottom member, the bases configured to:

provide traction between said two side members and the floor;

pivot said two side members to a plurality of angles from the floor; and position said two side members substantially perpendicular to a thigh of the treated leg, enabling said frame to induce a knee of the treated leg of the user to bend inwards or outwards in response to gravitational force affecting a lower portion of the treated leg.

2. The system of claim 1, wherein the system further comprises a handheld strap configured to engage a portion of the lower portion of the treated leg of the user, the handheld strap being further configured to actuate the lower portion of the treated leg to bend the knee of the treated leg inwards in response to force applied to the handheld strap by the user.

3. The system of claim 1, wherein the padded portion of the top member is further configured for engaging a portion of the treated leg proximate to the ankle, the padded portion further configured to support the ankle at an elevation allowing at least one of gravitational force or user force to induce extension of the knee of the treated leg.

4. The system of claim 1, wherein the padded portion of the top member is removably attached.

5. The system of claim 1, wherein the padded portion of the top member is translatable to a plurality of positions along the length of the top member.

6. The system of claim 1, wherein the padded portion of the top member comprises a deformable material.

7. The system of claim 1, wherein the bases include hinges configured to pivot the two side members to a plurality of angles with respect to the floor and allow the bases to maintain a flat contact with the floor.

8. The system of claim 1, wherein the substantially rectangular frame has an adjustable height.

9. The system of claim 1, wherein the substantially rectangular frame is collapsible.

10. A system for improving knee mobility after medical treatment for injury or disease, comprising:

a support mechanism disposed at an elevation in the approximate range of 15 to 40 inches from a surface of a floor, the support mechanism configured for receiving a user having undergone medical treatment affecting knee mobility, the support mechanism further configured for supporting the user in a seated position to alleviate pressure on the user's spine; and a rigid and substantially rectangular frame, said frame consisting of a top member, two side members and a bottom member arranged in a same plane to form the substantially rectangular frame, said bottom member configured to provide structural support for said frame, said top member configured for engaging a treated leg of the user at or near the popliteal space of the treated leg to support the popliteal space of the treated leg at a raised position, and said two side members being substantially parallel to one another and terminating in bases immediately adjacent to the bottom member, the bases configured to:

provide traction between said two side members and the floor, pivot said two side members to a plurality of angles from the floor; and position said two side members substantially perpendicular to a thigh of the treated leg, enabling said frame to induce a knee of the treated leg of the user to bend inwards in response to gravitational force affecting a lower portion of the treated leg.

11. The system of claim 10, wherein the top member of the frame includes a padded portion configured for engaging the treated leg of the user at or near the popliteal space of the treated leg.

12. The system of claim 10, wherein the system further comprises a handheld strap configured to engage a portion of the lower portion of the treated leg of the user, the handheld strap being further configured to actuate the lower portion of the treated leg to bend the knee of the treated leg inwards in response to force applied to the handheld strap by the user.

13. The system of claim 10, wherein the bases include hinges configured to pivot the two side members to a plurality of angles with respect to the floor and allow the bases to maintain a flat contact with the floor.

14. The system of claim 10, wherein the top member is positioned at an adjustable elevation from the floor.

15. The system of claim 10, wherein a distance between the two side members is adjustable.

16. A method of improving knee mobility of a user having undergone medical treatment, the method comprising the steps of:

supporting the user in a seated position to alleviate pressure on the user's spine;

providing a rigid and substantially rectangular frame to support a thigh of the treated leg, said frame having a predetermined width adapted to correspond to a waist size of a user, said frame consisting of a top member, two side members and a bottom member arranged in a same plane to form the substantially rectangular, said bottom member configured to provide structural support for said frame, wherein said top member has a padded portion configured for engaging the treated leg of the user at or near the popliteal space of the treated leg to support the popliteal space of the treated leg at a raised position, and wherein said two side members terminating in bases immediately adjacent to the bottom member, the bases configured to provide traction between said two side members and the floor and pivot said two side members to a plurality of angles from the floor, positioning said two side members substantially perpendicular to a thigh of the treated leg;

engaging the treated leg of the user at or near the popliteal space of the treated leg with a portion of the padded portion of the top member of the rectangular frame; and facilitating utilization of gravitational force to actuate a lower portion of the treated leg of the user to bend a knee of the treated leg inwards.

17. The method of claim 16, wherein the method further includes:

applying user force to actuate the lower portion of the treated leg of the user to bend the knee of the treated leg inwards.

18. The method of claim 17, wherein said step of applying user force to actuate the lower portion of the treated leg of the user to bend the knee of the treated leg inwards further includes:

utilizing a handheld strap, said handheld strap configured for engaging the lower portion of the treated leg.

19. The method of claim 16, wherein positioning said two side members substantially perpendicular to a thigh of the treated leg includes:

hingedly pivoting the two side members to a plurality of angles with respect to the floor while allowing the bases to maintain a flat contact with the floor.

* * * * *